US007749099B2

(12) United States Patent
Ban et al.

(10) Patent No.: US 7,749,099 B2
(45) Date of Patent: Jul. 6, 2010

(54) GOLF CLUB HEAD

(75) Inventors: Wataru Ban, Chichibu (JP); Fumiaki Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 49 days.

(21) Appl. No.: 12/238,159

(22) Filed: Sep. 25, 2008

(65) Prior Publication Data

US 2009/0197700 A1 Aug. 6, 2009

Related U.S. Application Data

(63) Continuation-in-part of application No. 12/041,948, filed on Mar. 4, 2008, now abandoned.

(30) Foreign Application Priority Data

Jan. 31, 2008 (JP) ..... 2008-021571
Aug. 8, 2008 (JP) ..... 2008-206385

(51) Int. Cl.
*A63B 53/04* (2006.01)

(52) U.S. Cl. ..... 473/331; 473/342

(58) Field of Classification Search ..... 473/324–350
See application file for complete search history.

(56) References Cited

U.S. PATENT DOCUMENTS 5,388,826 A * 2/1995 Sherwood ..... 473/291
6,733,400 B2 5/2004 Sherwood

* cited by examiner

*Primary Examiner*—Alvin A Hunter
(74) *Attorney, Agent, or Firm*—Paul, Hastings, Janofsky & Walker LLP

(57) ABSTRACT

This invention provides a golf club head including a plurality of score lines on the face. In the golf club head according to this invention, the score line includes a pair of side surfaces and a bottom portion having a protruding portion protruding toward the face. An angle between the side surface and the face is not less than 60 degrees. A cross-sectional area A ($inch^2$) of the score line, a width W (inch) of the score line measured based on the 30 degrees measurement method, and a distance S (inch) between the score lines adjacent to one another satisfy $A/(W+S) \leqq 0.003$.

8 Claims, 9 Drawing Sheets

FIG. 7

| | W (mm) | θa (°) | L1 (mm) | W+S (mm) | PROTRUDING PORTION | | | | | | EDGING | A ($mm^2$) | L2/L1 | A2/A1 |
|---|---|---|---|---|---|---|---|---|---|---|---|---|---|---|
| | | | | | Wp (mm) | Ws (mm) | R (mm) | L2 (mm) | SHAPE | A2 ($mm^2$) | | | | |
| #1 | 0.85 | 70 | 0.45 | 3.6 | | | | | | | NOT PERFORMED | 0.309 | | |
| #2 | | 50 | | | | | | | | | | 0.213 | | |
| #11 | | 70 | | | 0.31 | 0.12 | 0.05 | 0.40 | I | 0.124 | | 0.185 | 0.89 | 0.40 |
| #12 | | | | | | | | 0.27 | | 0.084 | | 0.225 | 0.60 | 0.27 |
| #13 | | | | | | | | | II | 0.081 | | 0.227 | 0.60 | 0.26 |
| #14 | | | | | | | | 0.31 | III | 0.084 | | 0.224 | 0.68 | 0.27 |
| #15 | | | | | | | | 0.35 | IV | 0.085 | | | 0.78 | 0.28 |
| #16 | | | | | 0.13 | | | 0.10 | I | 0.014 | PERFORMED | 0.222 | 0.22 | 0.06 |
| #17 | | | | | 0.18 | | | 0.20 | | 0.038 | | | 0.44 | 0.15 |
| #18 | | | | | 0.20 | | | 0.24 | V | 0.081 | NOT PERFORMED | 0.228 | 0.53 | 0.26 |
| #19 | | | | | 0.27 | | | 0.23 | VI | 0.083 | | 0.226 | 0.51 | 0.27 |

FIG. 8

| | RULE CONFORMANCE | | SPIN AMOUNT | SCRATCH |
|---|---|---|---|---|
| | AREA RULE | TWO-CIRCLE RULE | | |
| #1 | × | × | a | d |
| #2 | ○ | | d | c |
| #11 | | | | a |
| #12 | | | b | b |
| #13 | | | | |
| #14 | | | | |
| #15 | | | | |
| #16 | | ○ | c | a |
| #17 | | | | |
| #18 | | × | b | b |
| #19 | | | | |

GOLF CLUB HEAD

This is a continuation-in-part application of U.S. patent application Ser. No. 12/041,948 filed on Mar. 4, 2008, entitled "GOLF CLUB HEAD".

BACKGROUND OF THE INVENTION

1. Field of the Invention

The present invention relates to a golf club head and, more particularly, to score lines on the face.

2. Description of the Related Art

Generally, on the face of a golf club head, a plurality of straight grooves are formed parallel to each other in the toe-and-heel direction. These grooves are called score lines, marking lines, face lines, or the like (to be referred to as score lines in this specification). These score lines have an effect of increasing the back spin amount of a shot or suppressing a significant decrease in the back spin amount of a shot in case of a rainy day or a shot from the rough. For this reason, various shapes of a score line are proposed. For example, in the specification of the U.S. Pat. No. 6,733,400, there is disclosed an iron golf club set in which the heads of respective golf clubs include score lines each having a protrusion at its bottom portion, so as to adjust the back spin amount for each club number.

Factors of a score line which particularly influence the backspin amount are the edge angle of a score line, the depth of a score line, and the like. The smaller the edge angle of a score line, the higher the backspin amount. The larger the depth of a score line, the higher the backspin amount in case of a rainy day or a shot from rough.

However, according to the rule about the score lines of a golf club head for competitions, a cross-sectional area A ($inch^2$) of a score line, a width W (inch) of the score line measured based on the 30 degrees measurement method, and a distance S (inch) between the score lines adjacent to one another must satisfy $A/(W+S) \leqq 0.003$ (to be referred to as the area rule, hereinafter). When the edge angle of the score line is decreased or the depth of the score line is increased, the cross-sectional area of the score line increases, and therefore it may not conform to the area rule. On the contrary, when the score lines are formed to conform to the area rule, a sufficient backspin amount may not be obtained.

SUMMARY OF THE INVENTION

It is an object of the present invention to provide a golf club head which can provide a higher backspin amount while conforming to the area rule.

According to the present invention, there is provided a golf club head including a plurality of score lines on a face, wherein the score line includes a pair of side surfaces and a bottom portion having a protruding portion protruding toward the face, an angle between each side surface and the face is not less than 60 degrees, and a cross-sectional area A ($inch^2$) of the score line, a width W (inch) of the score line measured based on the 30 degrees measurement method, and a distance S (inch) between the score lines adjacent to one another satisfy the following expression, $A/(W+S) \leqq 0.003$.

According to the present invention, there is also provided a golf club head including a plurality of score lines on a face, wherein the score line includes a pair of side surfaces and a bottom portion having a protruding portion protruding toward the face, an angle between each side surface and the face is not less than 60 degrees, and a cross-sectional area A ($inch^2$) of the score lines a width W (inch) of the score line measured based on the 30 degrees measurement method, and a distance S (inch) between the score lines adjacent to one another satisfy the following expression, $A/(W+S) \leqq 0.0025$.

Further features of the present invention will become apparent from the following description of exemplary embodiments (with reference to the attached drawings).

BRIEF DESCRIPTION OF THE DRAWINGS

FIG. 7 is a table showing the specifications of score lines of golf club heads #1, #2 and #11 to #19.

FIG. 8 is a table showing the rule conformance of golf club heads #1, #2 and #11 to #19, and the backspin amount and degrees of scratch of balls as launch monitor results for golf clubs using these golf club heads.

DESCRIPTION OF THE EMBODIMENTS

Figure 1:
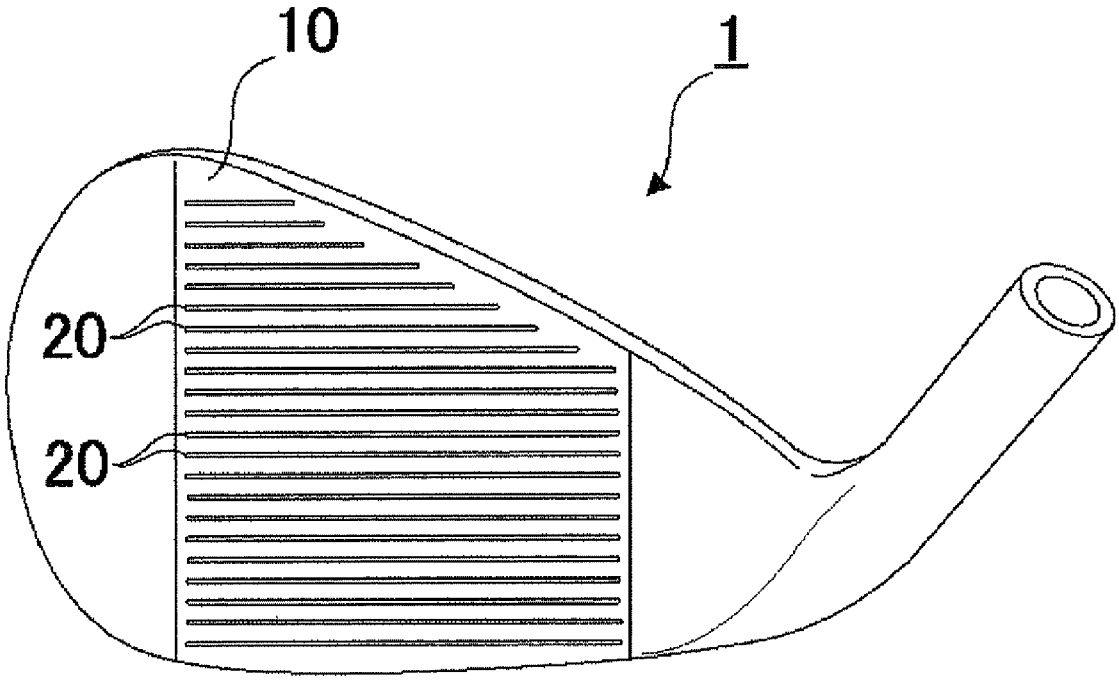
FIG. 1 is a view showing the outer appearance of a golf club head 1 according an embodiment of the present invention.

FIG. 1 is a view showing the outer appearance of a golf club head 1 according to an embodiment of the present invention. FIG. 1 shows an example in which the present invention is applied to an iron golf club head. The present invention is suitable for iron golf club heads, and particularly for middle iron golf club heads, short iron golf club heads, and wedge golf club heads. More specifically, the present invention is suitable for golf club heads with loft angles of 30° to 70° (both inclusive) and head weights of 240 g to 320 g (both inclusive). However, the present invention is also applicable to wood or utility (hybrid) golf club heads.

The golf club head 1 has a plurality of score lines 20 formed on its face 10. The respective score lines 20 are straight grooves extending in the toe-and-heel direction and parallel to each other.

Figure 2:
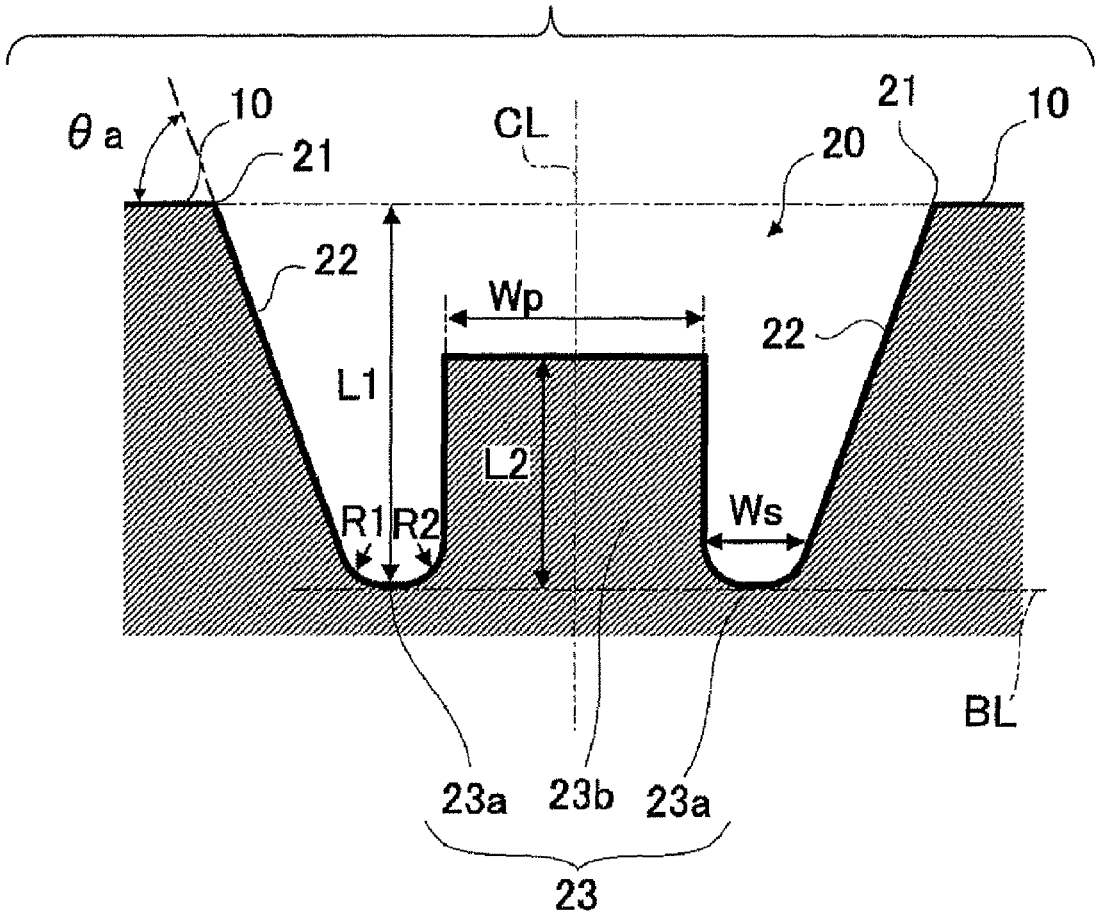
FIG. 2 shows a sectional view of a score line 20 in a direction perpendicular to the longitudinal direction (toe-and-heel direction), and views for explaining cross-sectional areas A, A1, and A2.
Figure 2:
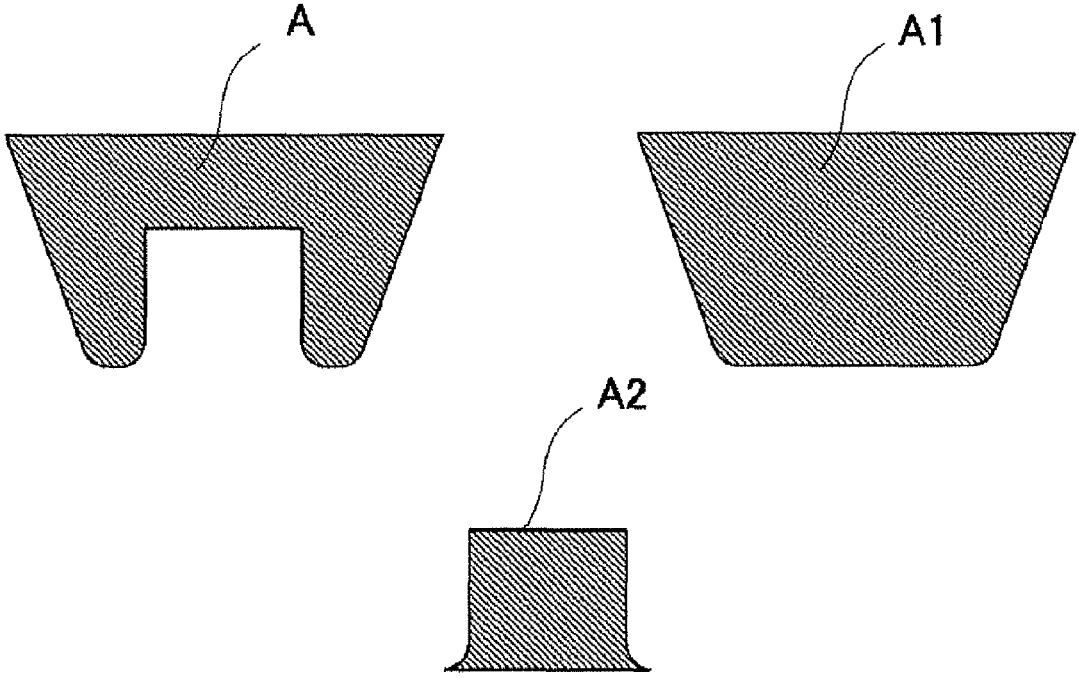

FIG. 2 shows a sectional view of the score line 20 in a direction perpendicular to the longitudinal direction (toe-and-heel direction), and views for explaining cross-sectional areas A, A1, and A2. In this embodiment, the cross-sectional shapes of the score lines 20 are the same except in two end portions in the longitudinal direction. The score lines 20 have the same cross-sectional shape. In this embodiment, the cross-sectional shape of the score line 20 is symmetric about a center line CL.

The score line 20 has a pair of side surfaces 22 and a bottom portion 23. An edge 21 of the score line 20 is the boundary portion of the side surface 22 and face 10. A rounding may be formed in the edge 21. The bottom portion 23 includes bottom surfaces 23*a* and a protruding portion 23*b*. The bottom surface 23*a* is parallel to the face 10. The protruding portion 23*b* is almost square, and its top portion includes a flat surface parallel to the face 10. A rounding with a radius R1 is formed in the boundary portion of the side surface 22 and bottom surface 23*a*, and a rounding with a radius R2 is formed in the boundary portion of the bottom surface 23*a* and protruding portion 23*b*. Of course, it is possible to employ an arrangement in which no rounding is formed in these boundary portions.

A width Wp indicates the maximum width of the protruding portion 23*b*. As in this embodiment, when a rounding is formed in each boundary portion of the bottom surface 23*a* and protruding portion 23*b*, the width Wp indicates the maximum width excluding the roundings. A width Ws indicates the minimum width between the side surface 22 and protruding portion 23*b*. As in this embodiment, when roundings are formed in the boundary portion of the side surface 22 and bottom surface 23*a* and that of the bottom surface 23*a* and protruding portion 23*b*, the width Ws indicates the minimum width excluding these roundings.

A distance L1 indicates the distance from the face 10 to the deepest portion in the score line 20. A distance L2 indicates the distance from the deepest portion in the score line 20 to the apex of the protruding portion 23*b*. An angle θa is the angle between the side surface 22 and face 10, which is set to 60° or more in this embodiment. The angle θa is preferably 90° or less. A virtual line BL is a virtual line parallel to the face 10 and passing the deepest portion in the score line 20.

The cross-sectional area A is the cross-sectional area of the score line 20, that is, the cross-sectional area of the cavity portion. The cross-sectional area A1 is the cross-sectional area of the score line 20 obtained when the protruding portion 23*b* is virtually cut off along the virtual line BL. That is, the cross-sectional area A1 corresponds to the cross-sectional area of the score line 20 when no protruding portion 23*b* is formed. The cross-sectional area A2 is the cross-sectional area of the protruding portion 23*b* virtually cut off along the virtual line BL. That is, A2=A1−A.

When the cross-sectional shape of the score line 20 is not symmetric about the center line CL, the virtual line BL is not a line parallel to the face 10 and passing the deepest portion in the score line 20, but a virtual line passing the deepest portion and second deepest portion of the score line 20.

Figure 3:
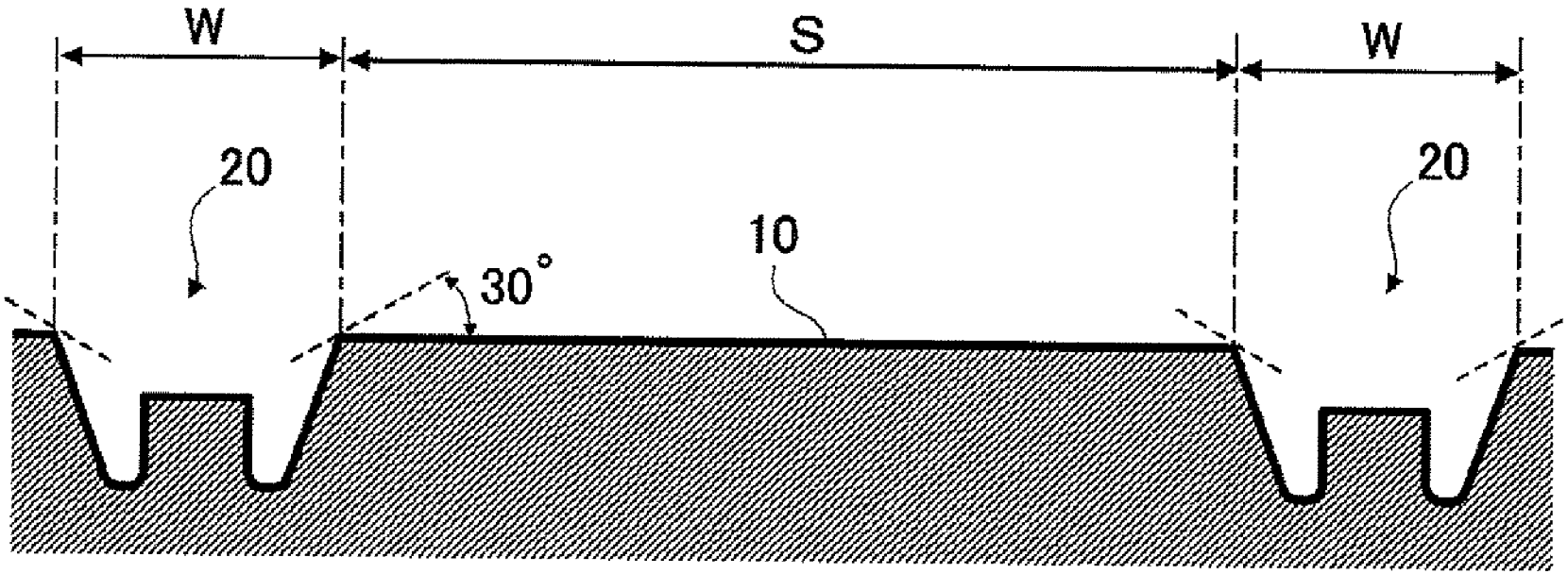
FIG. 3 is a view for explaining a width W of the score line 20 based on the 30 degrees measurement method and a distance S between the score lines 20.

FIG. 3 is a view for explaining a width W of the score line 20 based on the 30 degrees measurement method and a distance S between the score lines 20. The width W indicates the width measured based on the so-called 30 degrees measurement method as a rule about a golf club for competitions. That is, the width W indicates the distance between the contact points of the respective virtual lines with an angle of 30° with respect to the face 10 and the respective edges 21 of the score line 20. The distance S between the score lines 20 indicates the distance between the contact points of the respective virtual lines with an angle of 30° with respect to the face 10 and the respective edges 21 of the score lines 20 adjacent to one another. Note that the pitch (P) of the score lines 20 is obtained by P=W+S.

In this embodiment, the angle θa is set to 60° or more, as described above. With this arrangement, the angle (180°−θa) of the edge 21 of the score line 20 decreases, and therefore the backspin amount increases. On the other hand, as described above, since the area rule is defined as the rule about the score lines of a golf club head for competitions, the cross-sectional area A ($inch^2$)/(W(inch)+S (inch))≦0.003 must be satisfied. Note that the metric system expresses the cross-sectional area A ($mm^2$)/(W(mm)+S (mm))≦0.0762. Therefore, the golf club head 1 is designed so that the cross-sectional area A ($inch^2$)/(W(inch)+S (inch))≦0.003 is satisfied. If the golf club head 1 is designed so as to satisfy the cross-sectional area A ($inch^2$)/(W(inch)+S (inch))≦0.0025, the golf club head 1 can be better insured to meet the area rule.

When the angle θa is set to 60° or more, it is difficult to conform to the area rule. When the depth of the score line is decreased to conform to the area rule, it is difficult for water drops or grass on the face to escape into the score line. Accordingly, the backspin amount may decrease in case of a rainy day or a shot from the rough.

To solve this problem, the protruding portion 23*b* is formed in this embodiment. With this arrangement, the cross-sectional area A of the score line 20 decreases by the cross-sectional area of the protrusion portion 23*b*. Accordingly, it is possible to secure a larger distance as the distance L1 while setting the angle θa to 60° or more, thereby obtaining the high back spin amount while conforming to the area rule. The distance L1 is desirably 0.35 mm or more. When the distance L1 is 0.35 mm or more, a higher backspin amount can be expected. However, when the distance L1 is smaller than 0.35 mm, it is possible to obtain the arrangement which can conform to the area rule without the protruding portion 23*b*. This makes formation of the protruding portion 23*b* less important.

Assume that the distance L2 is set larger so that the position of the top portion of the protruding portion 23*b* is close to the face 10. In this case, upon hitting a ball, the ball deforms, and a part of the ball enters into the score line 20 and touches the protruding portion 23*b*. In this case, the effect of increasing the backspin amount of the ball may occur, but the ball may be damaged. As in this embodiment, when the top portion of the protruding portion 23*b* is formed to be a flat surface parallel to the face 10, the effect of increasing the backspin amount of a ball is small, but damage to a ball can be prevented.

As a method of forming the score lines 20, cutting, forging, casting, electrical discharge machining, or the like is available. In case of electrical discharge machining, for example, diesinking electric discharge is applicable.

Figure 4:
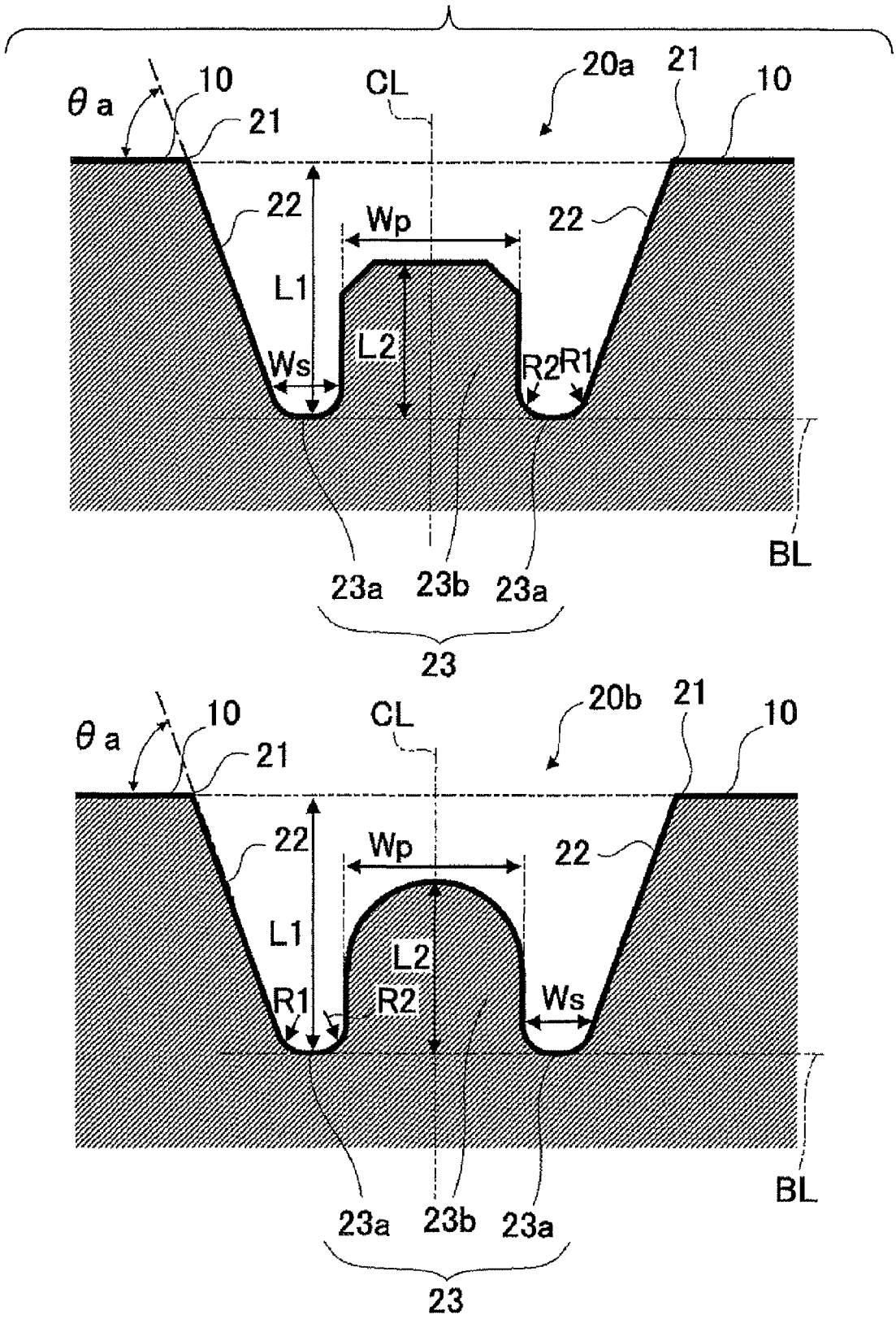
FIG. 4 shows views of other arrangement examples (two examples) of a protruding portion 23*b*.
Figure 5:
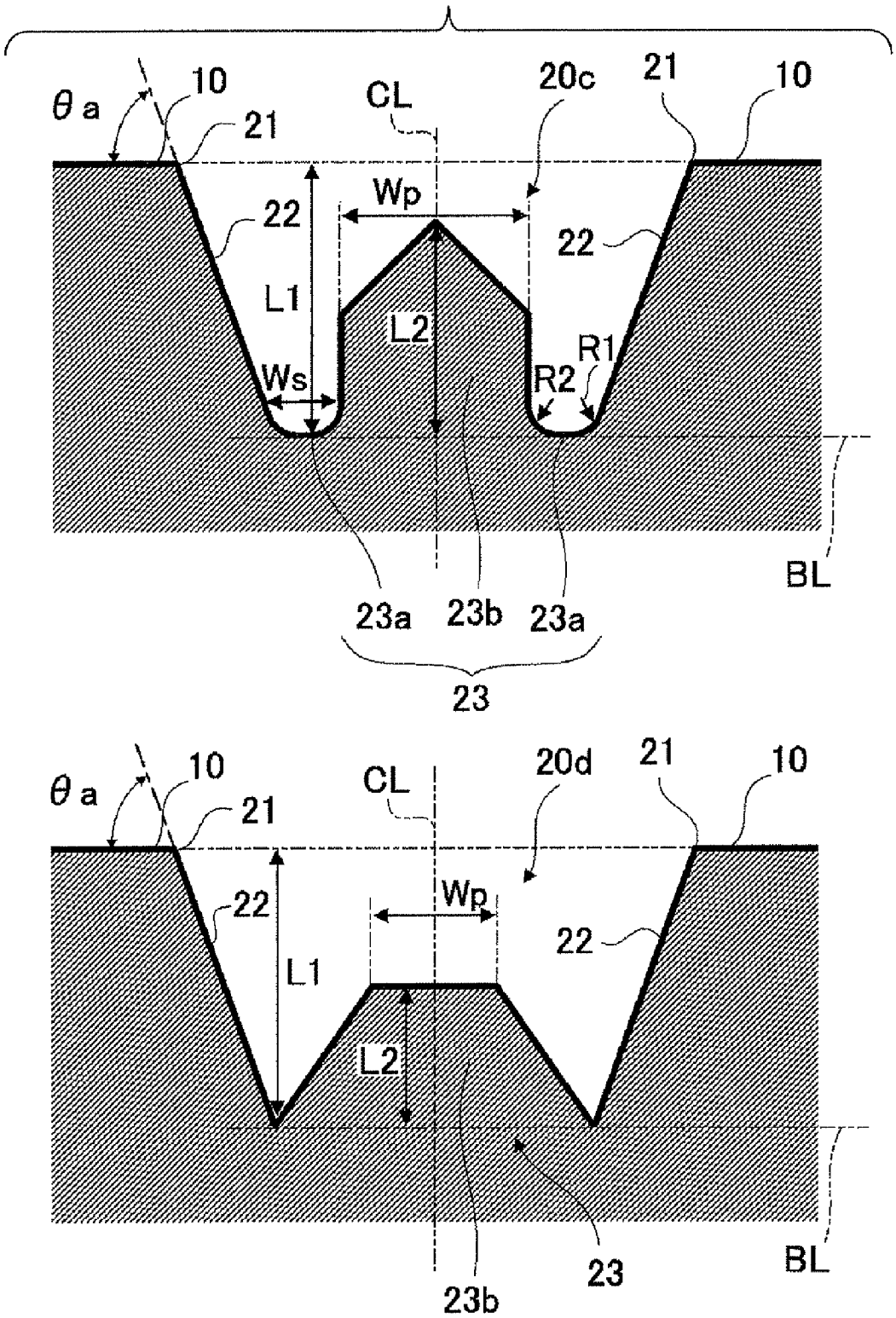
FIG. 5 shows views of still other arrangement examples (two examples) of the protruding portion 23*b*.
Figure 6:
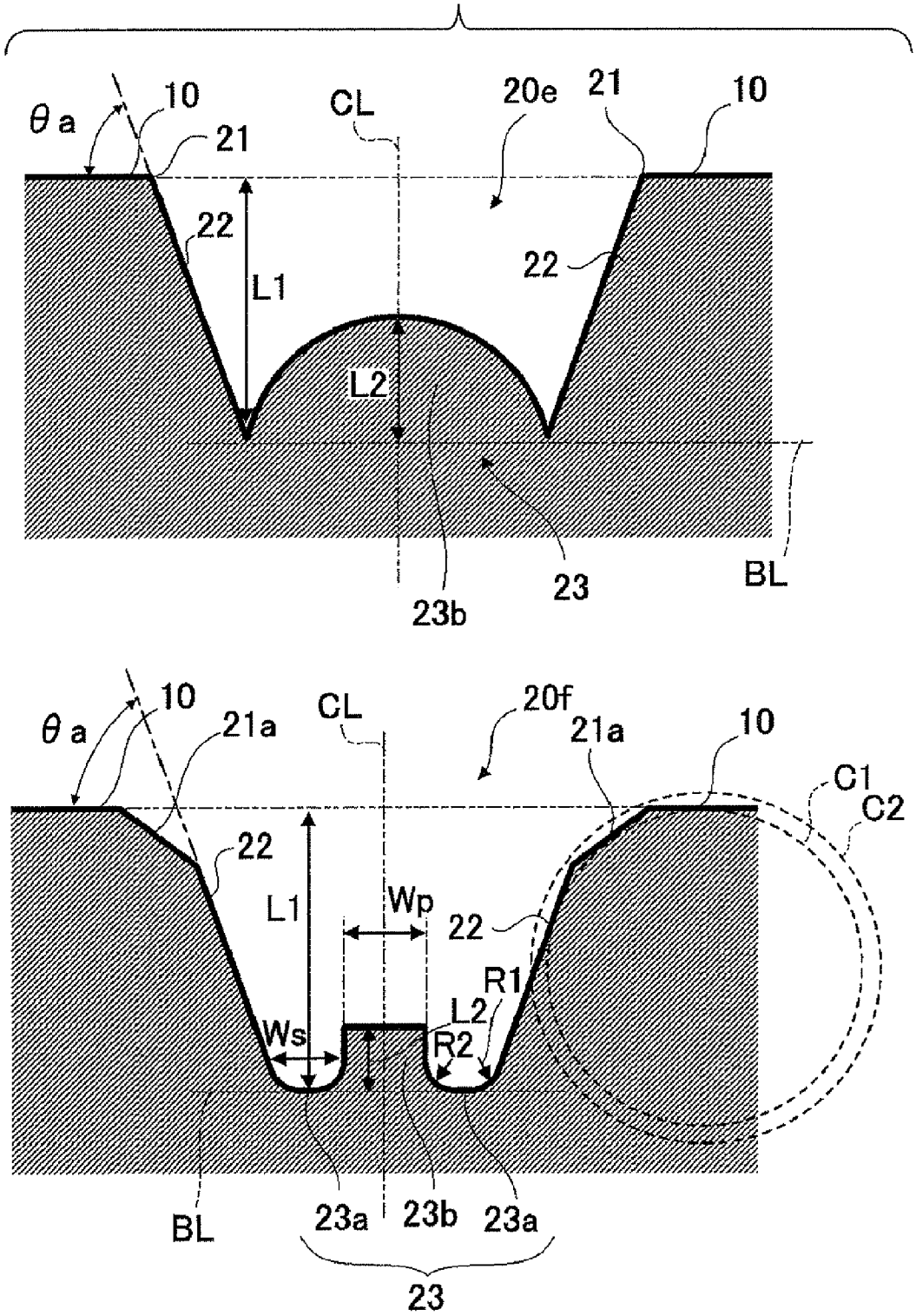
FIG. 6 shows views of still other arrangement examples (two examples) of the protruding portion 23*b*.

Other arrangement examples of the protruding portion 23*b* will be described with reference to FIGS. 4 to 6. Each of FIGS. 4 to 6 shows two examples. Note that the same reference numerals as in FIG. 2 are used in FIGS. 4 to 6, unless otherwise specified, and the same reference numerals as in FIG. 2 denote the same parts in FIGS. 4 to 6.

In a score line 20*a* shown in the upper view of FIG. 4, the left and right square portions of the top portion of the protruding portion 23*b* of the score line 20 shown in FIG. 2 are chamfered to be flat surfaces. In this arrangement, it is possible to further prevent the top portion of the protruding portion 23*b* from damaging a ball upon hitting the ball. In a score line 20*b* shown in the lower view of FIG. 4, the cross-sectional shape of the top portion of the protruding portion 23*b* is formed to be a semicircle. In this arrangement, it is possible to further prevent the top portion of the protruding portion 23*b* from damaging a ball upon hitting the ball. In a score line 20*c* shown in the upper view of FIG. 5, the cross-sectional shape of the top portion of the protruding portion 23*b* of the score line 20 shown in FIG. 2 is formed to be a triangle. In this arrangement, when the top portion of the protruding portion 23*b* touches a ball upon hitting the ball, the backspin amount of the ball can be increased.

A score line 20*d* in the lower view of FIG. 5 shows an example in which the bottom portion 23 includes only the protruding portion 23*b*. That is, the score line 20*d* does not include the bottom surfaces 23*a* in the score line 20 shown in FIG. 2. In this case, the protruding portion 23*b* continues to each of the side surfaces 22. In the score line 20*d* in FIG. 5, the cross-sectional shape of the protruding portion 23*b* is formed to be a trapezoid. A score line 20*e* in the upper view of FIG. 6 also shows a case in which the bottom portion 23 includes only the protruding portion 23*b*. In the score line 20*e* in FIG. 6, the cross-sectional shape of the protruding portion 23*b* is formed to be a semicircle.

In a score line 20*f* in the lower view of FIG. 6, the edge 21 is machined to form a flat surface 21*a*. As the rule about score lines of a golf club head for competitions, in addition to the area rule, each edge of a score line must be positioned within a virtual circle with a radius of 0.011 inches concentric with a virtual circle with a radius of 0.010 inches which internally touches the side surface of the score line and the face (to be referred to as a two-circle rule, hereinafter).

In order to satisfy the two-circle rule, however, it is necessary to decrease the angle between each side surface of the score lines and the face. In this case, the edge angle of the score line increases, resulting in not only a decrease in the spin amount but also a decrease in the volume of the score line. Accordingly, a spin amount may significantly decrease in case of a shot from rough or a shot on a rainy day.

A virtual circle C1 in the lower view of FIG. 6 is a circle with a radius of 0.010 inches which internally touches the side surface 21 and face 10. A virtual circle C2 is a circle with a radius of 0.011 inches which is concentric with the virtual circle C1. In order to conform to the two-circle rule described above, the edge of the score line 20 needs to be positioned within the virtual circle C2.

When the flat surface 21*a* is formed in the edge 21 of the score line 20*f*, the two-circle rule is satisfied in addition to the area rule. The shape of the edge 21 may be a rounding or notch other than the flat surface 21*a*.

EXAMPLES

Golf club heads #1, #2 and #11 to #19 having different specifications of score lines were fabricated. FIG. 7 is a table showing the specifications of score lines of golf club heads #1, #2 and #11 to #19. FIG. 8 is a table showing the rule conformance of golf club heads #1, #2 and #11 to #19, and the backspin amount and degrees of scratch of balls as launch monitor results for golf clubs using these golf club heads.

Figure 9:
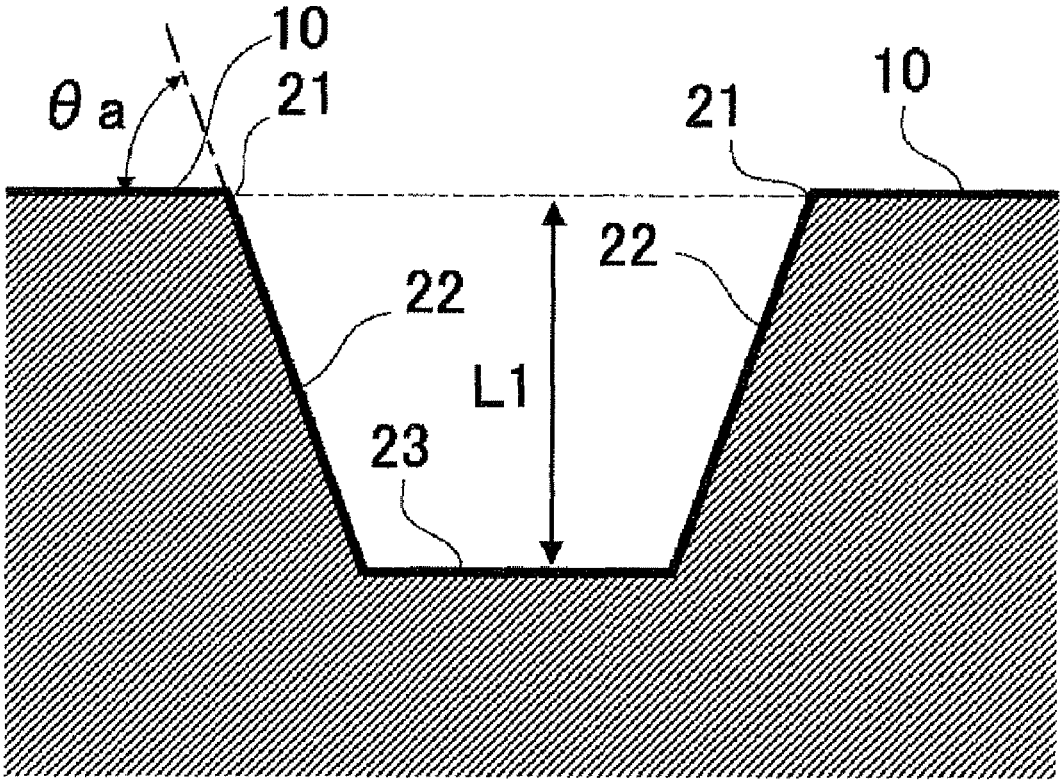
FIG. 9 is a view showing the cross-sectional shape of a score line of golf club heads #1 and #2.

In golf club heads #1 and #2, the cross-sectional shape of a score line is that shown in FIG. 9, which includes no protruding portion 23*b* described above. Golf club heads #11 to #19 respectively have the protruding portions 23*b* described above. Note that in each of golf club heads #1, #2 and #11 to #19, the cross-sectional shape of a score line is symmetric about the center line.

In FIG. 7, "W" indicates the width of the score line, which is the width W measured based on the degrees measurement method described above. "θa" indicates the angle θa described above. "L1" indicates the distance L1 described above, which is the distance from the face to the deepest portion in the score line. "P" indicates the pitch of the score lines, which is the length obtained by adding the distance S to the width W described above, that is, P=S+W.

"Wp" and "Ws" indicate the above-described widths Wp and Ws, respectively, of the protruding portion 23*b*. "R" corresponds to the R1 and R2 described above, and R1=R2=R in this embodiment. "L2" indicates the distance L2 described above, which is the distance from the virtual line BL to the apex of the protruding portion 23*b*. "Shape" indicates the type of the cross-sectional shape of the protruding portion 23*b*, in which I corresponds to the cross-sectional shape of the score line 20 shown in FIG. 2, II corresponds to that of the score line 20*a* shown in the upper view of FIG. 4, III corresponds to that of the score line 20*b* shown in the lower view of FIG. 4, IV corresponds to that of the score line 20*c* shown in the upper view of FIG. 5, V corresponds to that of the score line 20*d* shown in the lower view of FIG. 5, and VI corresponds to that of the score line 20*e* shown in the upper view of FIG. 6. "A2" indicates the cross-sectional area A2 shown in FIG. 2, which is the cross-sectional area of the protruding portion 23*b* cut off along the virtual line BL.

"Edging" indicates whether the flat surface 21*a* is formed in the edge 21 so as to conform to the two-circle rule, like the score line 20*f* shown in the lower view of FIG. 6. In these examples, such machining was performed for the edges of the score lines of golf club heads #16 and #17.

"A" indicates the cross-sectional area A shown in FIG. 2, which is the cross-sectional area of the score line. "L2/L1" indicates a value obtained by dividing the distance L2 by the distance L1. "A2/A1" indicates a value obtained by dividing the cross-sectional area A2 by the cross-sectional area A1. The cross-sectional area A1 is the cross-sectional area shown in FIG. 2, that is, A1=A+A2.

In FIG. 8, "rule conformance" indicates conformance to the rule about a golf club head for competitions, in which the conformance to the area rule and the two-circle rule are indicated. ○ indicates "conform", and X indicates "not conform". "Spin amount" indicates the evaluation obtained by hitting a ball using a golf club mounted with each of golf club heads #1, #2, and #11 to #19, actually measuring the backspin amount of the ball, and evaluating the backspin amount on four levels. "a" indicates the highest spin amount, and "d" indicates the lowest spin amount. "Scratch" indicates the evaluation obtained by hitting a ball using a golf club mounted with each of golf club heads #1, #2, and #11 to #19, visually checking the degree of scratch of the ball, and evaluating the degree of scratch on four levels. "a" indicates the lowest degree of scratch, and "d" indicates the highest degree of scratch.

In golf club heads #1 and #2, the score lines include no protruding portion 23*b*. Golf club head #1 has the angle θa of 70° and excellent spin amount, but it does not conform to the area rule. Golf club head #2 has the angle θa of 50° and conforms to the area rule, but its spin amount is low. From the viewpoint of spin amount, the angle θa is desirably 60° or more.

Each of golf club heads #11 to #19 has the angle θa of 70°, but it conforms to the area rule. This is because the protruding portions 23*b* are formed. In addition, golf club heads #16 and #17 conform to the two-circle rule as well. This is because the flat surfaces 21*a* are formed.

Now, L2/L1 is considered. The larger value of L2/L1 indicates that the top portion of the protruding portion 23*b* is closer to the face, and the smaller value of L2/L1 indicates that the top portion of the protruding portion 23*b* is away from the face. Golf club head #11 in which L2/L1=0.89 has a low backspin amount of the ball. It is assumed that since a ball strongly interferes with the protruding portion 23*b* upon hitting the ball, it does not enter into the score line and therefore does not spin. On the other hand, golf club head #15 in which L2/L1=0.78 obtains a certain backspin amount of the ball. Therefore, from the viewpoint of the backspin amount of the ball, L2/L1≦0.8 is desirable.

Next, A2/A1 is considered. Larger the value of A2/A1, larger the space occupied by the protruding portion 23*b* in the score line, and smaller the value of A2/A1 smaller the space occupied by the protruding portion 23*b* in the score line. Golf club head #11 in which A2/A1=0.40 has a low backspin amount of the ball. It is assumed that since a ball strongly interferes with the protruding portion 23*b* upon hitting the ball, it does not enter into the score line and therefore does not spin. On the other hand, golf club head #15 in which A2/A1=0.28 obtains a certain backspin amount of the ball.

Golf club heads #12, #14, and #19 in which A2/A1=0.27 respectively obtain a certain backspin amount of the ball. Therefore, from the viewpoint of the backspin amount of a ball, A2/A1≦0.3 is desirable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2008-21571, filed Jan. 31, 2008 and No. 2008-206385, filed Aug. 8, 2008, which are hereby incorporated by reference herein in their entirety.

What is claimed is:

1. A golf club head including a plurality of score lines on a face, wherein each of said score lines includes:

a pair of side surfaces; and a bottom portion having a protruding portion protruding toward said face, an angle between each side surface of said score lines and said face is not less than 60 degrees, a cross section area A (inch$^2$), a width W (inch) of said score line measured based on the 30 degrees measurement rule and a distance S (inch) between said score lines adjacent to one another satisfy the following expression:

$$A/(W+S) \leqq 0.003, \text{ and}$$

edges of said score lines are formed to be positioned within a second virtual circle with a radius of 0.011 inches, the second virtual circle being concentric with a first virtual circle which internally touches said side surface and said face with a radius of 0.010 inches.

2. The golf club head according to claim 1, wherein a distance L1 from said face to the deepest portion in said score line is not less than 0.35 mm.

3. The golf club head according to claim 1, wherein a distance L1 from said face to the deepest portion in said score line and a distance L2 from the deepest portion to the apex of the protruding portion satisfy the following expression:

$$L2/L1 \leqq 0.8.$$

4. The golf club head according to claim 1, wherein a cross section shape of said score line is symmetric about a center line thereof, and a cross section area A1 of said score line where said protruding portion is virtually cut off along a virtual line passing the deepest portion in the score line and parallel to said face and a cross section area A2 of the virtually-cut off protruding portion satisfy the following expression:

$$A2/A1 \leqq 0.3.$$

5. A golf club head including a plurality of score lines on a face, wherein each of said score lines includes:

a pair of side surfaces; and a bottom portion having a protruding portion protruding toward said face, an angle between each side surface of said score lines and said face is not less than 60 degrees, and a cross section area A (inch$^2$), a width W (inch) of said score line measured based on the 30 degrees measurement rule and a distance S (inch) between said score lines adjacent to one another satisfy the following expression:

$$A/(W+S) \leqq 0.0025, \text{ and}$$

edges of said score lines are formed to be positioned within a second virtual circle with a radius of 0.011 inches, the second virtual circle being concentric with a first virtual circle which internally touches said side surface and said face with a radius of 0.010 inches.

6. The golf club head according to claim 5, wherein a distance L1 from said face to the deepest portion in said score line is not less than 0.35 mm.

7. The golf club head according to claim 5, wherein a distance L1 from said face to the deepest portion in said score line and a distance L2 from the deepest portion to the apex of the protruding portion satisfy the following expression:

$$L2/L1 \leqq 0.8.$$

8. The golf club head according to claim 5, wherein a cross section shape of said score line is symmetric about a center line thereof, and a cross section area A1 of said score line where said protruding portion is virtually cut off along a virtual line passing the deepest portion in the score line and parallel to said face and a cross section area A2 of the virtually-cut off protruding portion satisfy the following expression:

$$A2/A1 \leqq 0.3.$$

* * * * *